United States Patent [19]

Streit

[11] 4,389,078

[45] Jun. 21, 1983

[54] MODULAR STORAGE UNIT

[75] Inventor: Kenneth F. Streit, Mt. Prospect, Ill.

[73] Assignee: Techplastics, Inc., West Chicago, Ill.

[21] Appl. No.: 229,650

[22] Filed: Jan. 29, 1981

[51] Int. Cl.[3] ..... A47B 88/00; F16B 12/00

[52] U.S. Cl. ..... 312/322; 312/107; 312/111; 312/295

[58] Field of Search ..... 312/322, 348, 350, 250, 312/111, 108, 107, 295

[56] References Cited

U.S. PATENT DOCUMENTS

| | | | |
|---|---|---|---|
| 640,078 | 12/1899 | Baker | 312/107 |
| 641,459 | 1/1900 | Macey | 312/107 |
| 755,615 | 3/1904 | Chatterton | 312/107 |
| 947,842 | 2/1910 | Ohnstrand | 312/348 |
| 2,785,940 | 3/1957 | Felton | 312/111 |
| 3,661,434 | 5/1972 | Alster | 312/111 |
| 3,716,282 | 2/1973 | Propst et al. | 312/322 |
| 3,752,547 | 8/1973 | Propst et al. | 312/107 |
| 3,946,865 | 3/1976 | Bierwas | 312/111 |
| 3,980,363 | 9/1976 | Dean et al. | 312/322 |
| 4,047,773 | 9/1977 | Semany | 312/111 |
| 4,094,526 | 6/1978 | Clarke et al. | 312/250 |
| 4,140,356 | 2/1977 | Chervanak | 312/111 |
| 4,172,625 | 10/1979 | Swain | 312/348 |
| 4,239,306 | 12/1980 | Klaus | 312/111 |

*Primary Examiner*—Victor N. Sakran

*Attorney, Agent, or Firm*—Dressler, Goldsmith, Shore, Sutker & Milnamow, Ltd.

[57] ABSTRACT

A storage unit is provided that may be assembled with other similar storage units in a vertical and horizontal array. Each storage unit comprises material molded to form a pair of opposed walls, a rear wall, a bottom wall, and a top wall together defining a generally box-like structure having an open front. A movable closure panel is provided for closing the front of the unit and is adapted to be stored in a horizontal position within the unit underneath of the top wall of the unit. Various types of receptacles are provided for being disposed within the unit and are adapted to be pulled outwardly from the unit to permit loading and unloading of the receptacles. The receptacles may also be removed entirely from the storage unit. Clip devices are provided for holding the adjacent storage units together.

15 Claims, 19 Drawing Figures

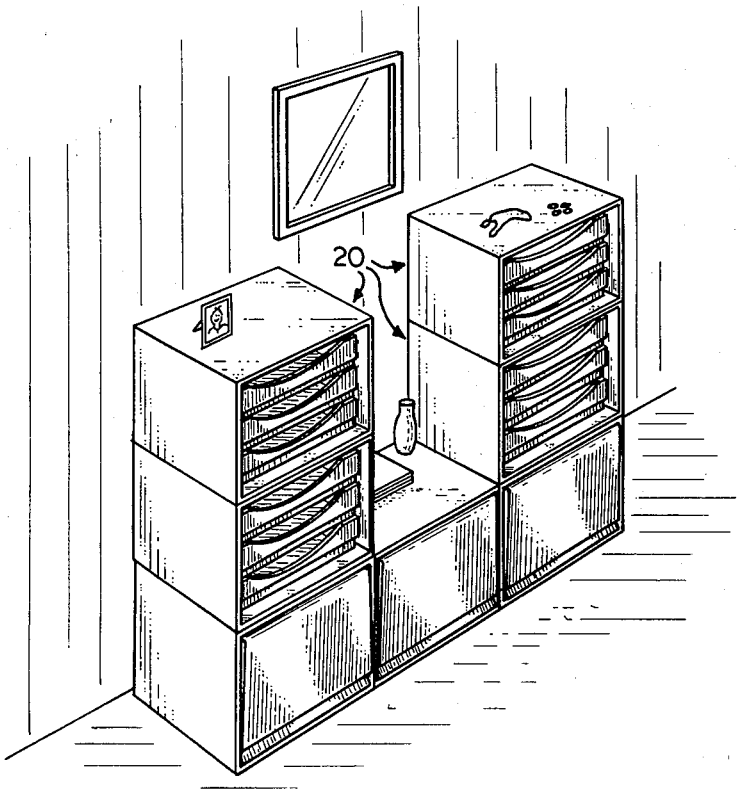
FIG. 15
FIG. 16
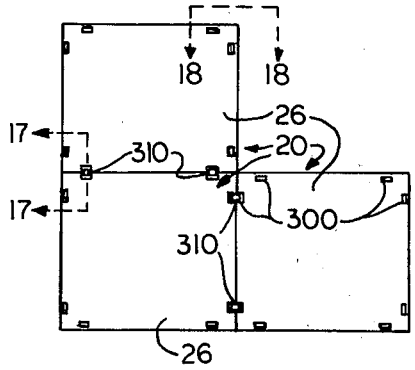
FIG. 17
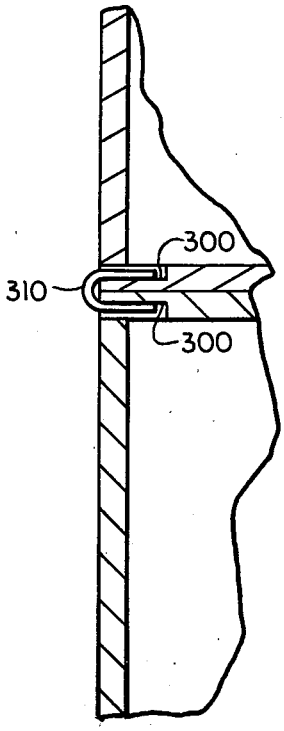
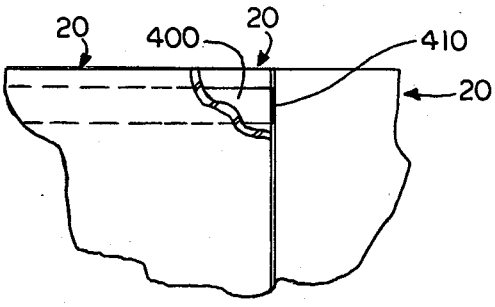
FIG. 18

MODULAR STORAGE UNIT

TECHNICAL FIELD

This invention relates to shelving, cabinets, and other types of enclosure devices for storing articles.

BACKGROUND OF THE INVENTION

A variety of storage containers have been disclosed for use in many environments. For example, the U.S. Pat. No. 3,716,282 discloses a mobile drawer designed for use in a hospital environment.

U.S. Pat. No. 4,140,356 discloses a modular cell unit for storage of trays and drawers located within the unit. The unit may be readily secured to a wall.

U.S. Pat. No. 3,661,434 discloses a unitary modular shelving structure assembled from a plurality of modular plate-like members to form an array of modules in vertically and horizontally extending rows.

SUMMARY OF THE INVENTION

A storage unit is provided from material molded to form a pair of opposed sidewalls, a rear wall, a bottom wall, and a top wall that together define a generally box-like structure having an open front.

A movable closure panel is provided to close the front of the unit. The closure panel has two protuberances at the top of the panel which extend outwardly from, and downwardly over, the inner surface of the panel to define a receiving notch.

Each of the sidewalls of the unit has an integrally molded closure panel support flange projecting into the interior of the storage unit and spaced below the top wall to define a space for receiving a side margin of the closure panel whereby the panel may be stored in a horizontal position on the flanges.

Two panel pivot clips formed from a resilient material are secured to a front end of the sidewall flanges whereby the closure panel may be slid along the flanges of the unit from a substantially horizontal position within the unit so that each receiving notch is engaged by one of the panel pivot clips to pivot the panel to a substantially vertical position closing the opening of the front of the unit.

The unit also includes a number of other features, such as receptacles slidably mounted between guide rails on the opposed sidewalls of the unit, devices for connecting adjacent units together, and a base unit with casters to provide a mobile unit.

Numerous other advantages and features of the present invention will become readily apparent from the following detailed description of the invention and embodiments thereof, from the claims, and from the accompanying drawings.

BRIEF DESCRIPTION OF THE DRAWINGS

In the accompanying drawings forming part of the specification, and in which like numerals are employed to designate like parts throughout the same.

FIG. 15 is a view of a plurality of storage units arranged in a horizontal and stacked vertical array in accordance with the teachings of the present invention;

FIG. 16 is a rear view of three storage units arranged in a L-shaped array and secured together;

FIG. 17 is a greatly enlarged, fragmentary, cross-sectional view taken generally along the plane 17—17 in FIG. 16; and FIG. 18 is a greatly enlarged, top plan view of the storage units shown in FIG. 16 with a portion of the uppermost storage unit broken away to better illustrate the securement means between it and the storage unit below.

DESCRIPTION OF THE PREFERRED EMBODIMENTS

Figure 1:
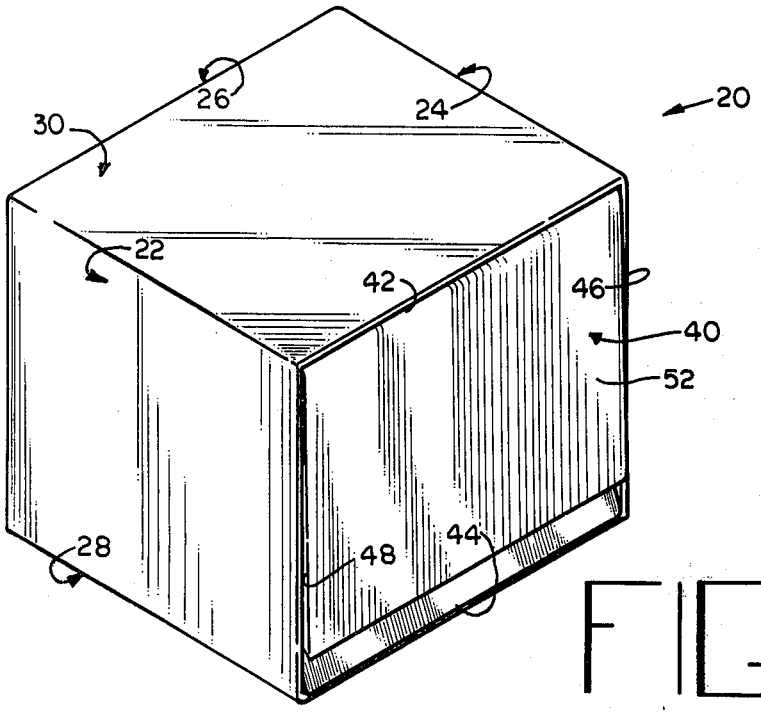
FIG. 1 is a perspective view of the modular storage unit of the present invention shown with the closure panel in the position to close the front opening of the unit.

While this invention is susceptible of embodiment in many different forms, there are shown in the drawings and will herein be described in detail preferred embodiments of the invention. It will be understood, however, that the present disclosure is to be considered as an exemplification of the principles of the invention and is not intended to limit the invention to the embodiments illustrated.

The precise shapes and sizes of the components herein illustrated are not essential to the apparatus unless otherwise indicated.

For ease of description, the apparatus disclosed herein will be described in the normal operating position and terms such as upper, lower, horizontal, etc., will be used with reference to the normal operating position. It will be understood, however, that the apparatus may be manufactured, stored, transported and sold in an orientation other than that normal operating position described.

Figure 2:
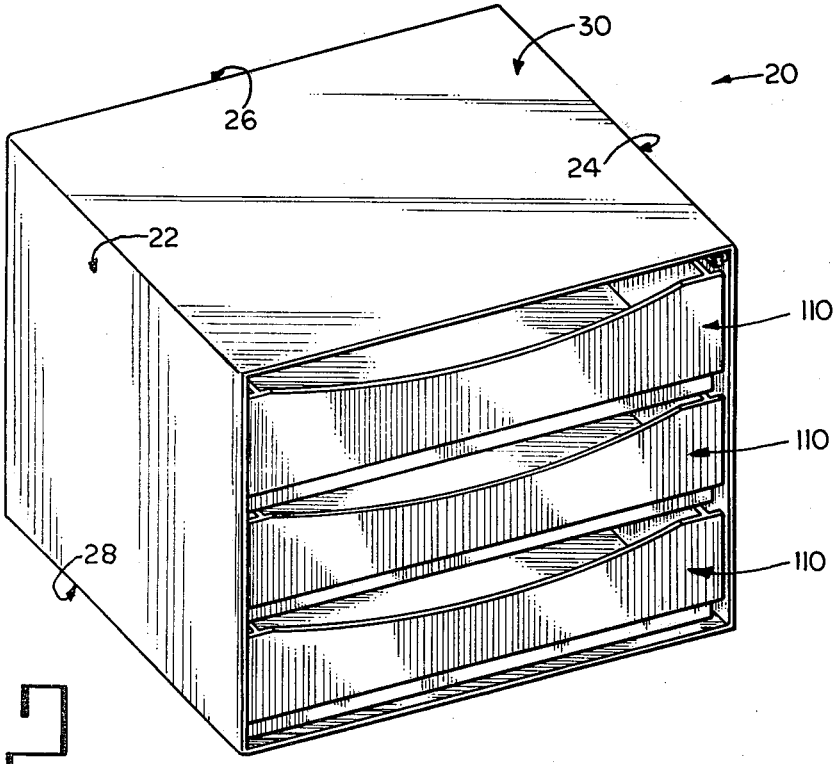
FIG. 2 is a view similar to FIG. 1 but showing the unit with the closure panel in a retracted horizontal position to open front of the unit and expose drawers mounted therein.
Figure 3:
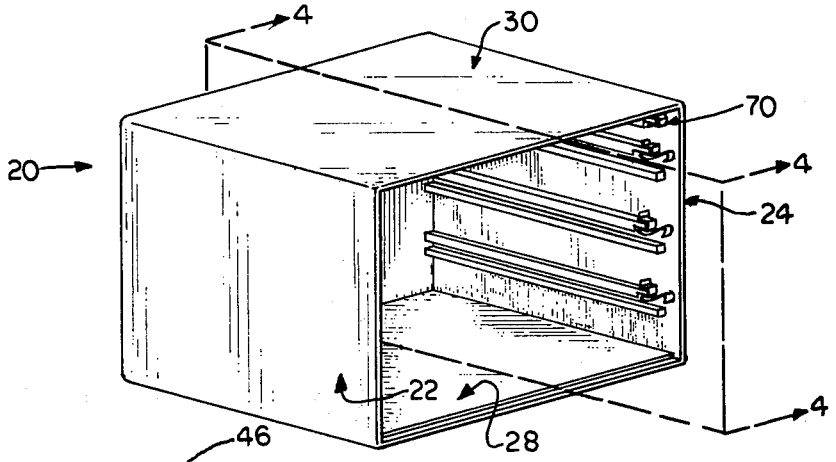
FIG. 3 is a view similar to FIG. 2 but with the drawers removed from the unit.

Referring now to the drawings, the exterior appearance of the modular storage unit of the present invention is best illustrated in FIGS. 1 and 2 wherein the storage unit is designated generally by reference numeral 20. The storage unit is molded as a unitary structure from a suitable material, such as a structural foam polyolefin plastic. The unit has a pair of opposed sidewalls 22 and 24, a rear wall 26, a bottom wall 28, and a top wall 30. These walls cooperate to form a generally box-like structure having an opened front that, in FIG. 1, is illustrated as being closed by a movable closure panel 40. In FIG. 2, the closure panel 40 is not visible, having been raised to a horizontal storage position within the unit below the top wall 30.

The modular storage unit 20 is illustrated as having a generally cubic configuration. However, the storage unit 20 may have other suitable configurations, such as a rectangular prism with the height, depth, and width being of differing dimensions. As described in more detail hereinafter, a number of storage units 20 may be placed together side-by-side or one on top of another to form a larger storage system.

As best illustrated in FIGS. 1, 3, 4, and 4A, the movable closure panel 40 has a top margin 42, a bottom margin 44 and opposed side margins 46 and 48. The movable closure panel 40 has an interior surface 50 (FIG. 4) adapted to face the interior of the unit and an exterior surface 52 (FIGS. 1 and 4) facing outwardly when the panel 40 is positioned to close the front of the storage unit 20.

Figure 4A:
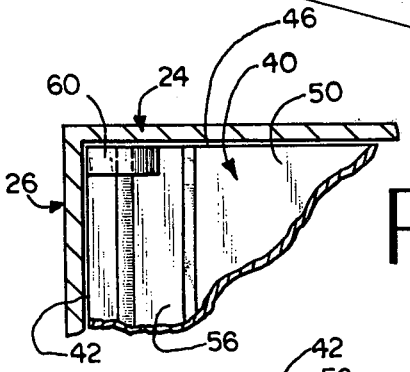
FIG. 4A is a greatly enlarged, fragmentary, cross-sectional view taken generally along the planes 4A—4A in FIG. 4.

The interior surface 50 of the movable closure panel 40 defines a channel 56 (FIGS. 4 and 4A) spaced inwardly of the top margin 42 at each side margin, such as at side margin 46 illustrated in FIG. 4A. Preferably, the channel 56 along one side margin of the closure panel 40 extends across the panel to join the other channel that extends from the other side margin of the panel to thereby form a single, continuous channel across the panel.

Figure 4:
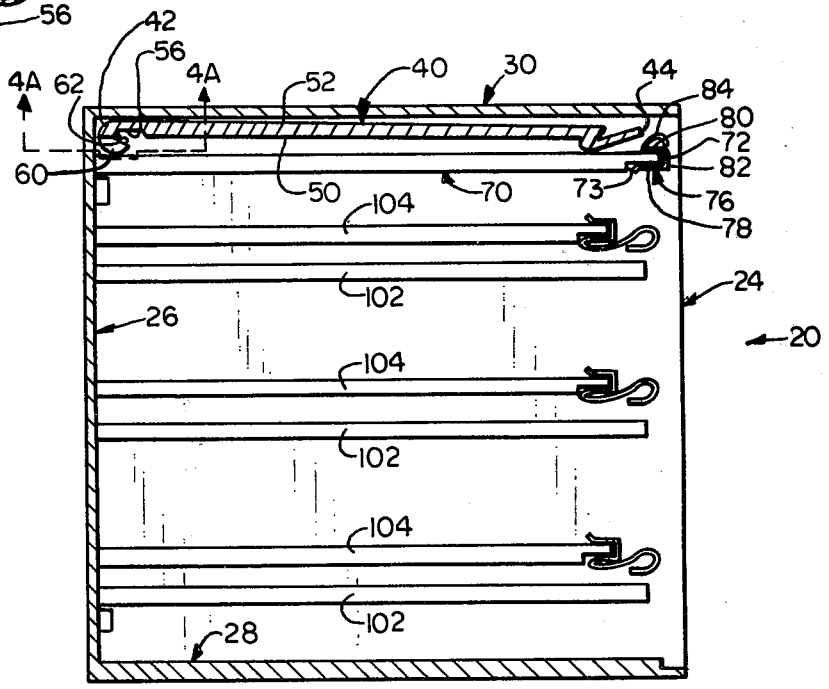
FIG. 4 is an enlarged, cross-sectional view taken generally along the plane 4—4 in FIG. 3.

The movable closure panel 40 further has two protuberances, such as protuberance 60 illustrated in FIGS. 4 and 4A. Each protuberance projects outwardly from the interior surface 50 and extends downwardly from the closure panel top margin 42 at one of the side margins. Protuberance 60 illustrated in FIG. 4A is seen to extend from the top margin 42 at side margin 46 of the movable closure panel 40. Each protuberance overlies a portion of the channel 56 to define a receiving notch 62 (FIG. 4) between the channel 56 and the overlying portion of the protuberance 60.

Figure 9:
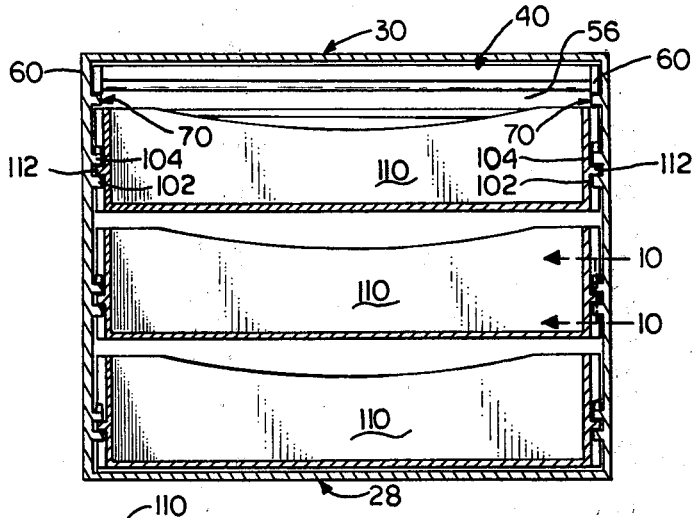
FIG. 9 is a slightly reduced cross-sectional view taken generally along the plane 9—9 in FIG. 7.

As best illustrated in FIGS. 4 and 9, the sidewalls 22 and 24 of the storage unit 20 carry closure panel support flanges 70. One flange 70 is on each of the opposed sidewalls spaced below the top wall 30 to define a space for receiving the side margins of the closure panel 40 when the closure panel is stored in a horizontal position on the flanges 70. Each flange 70 terminates in a front end 72 (FIG. 4) spaced inwardly of the front of the storage unit.

At the front end 72 of each of the panel support flange is disposed a panel pivot clip 76 to aid in closing the unit with the panel. Each pivot clip 76 is made from a resilient material and has a first leg 78, a second leg 80, and a middle connection portion 82 joining the first leg 78 and the second leg 80 in a generally U-shaped configuration. Each clip 76 is positioned on the front end 72 of a flange 70 with the flange 70 disposed between, and resiliently engaged by, the first leg 78 below the flange and the second leg 80 above the flange. Preferably, the bottom of each flange 70 is notched, as at 73 at the front end 72 to define a portion of the flange 70 having a reduced height or thickness on which the panel pivot clip 76 is disposed.

Figure 6:
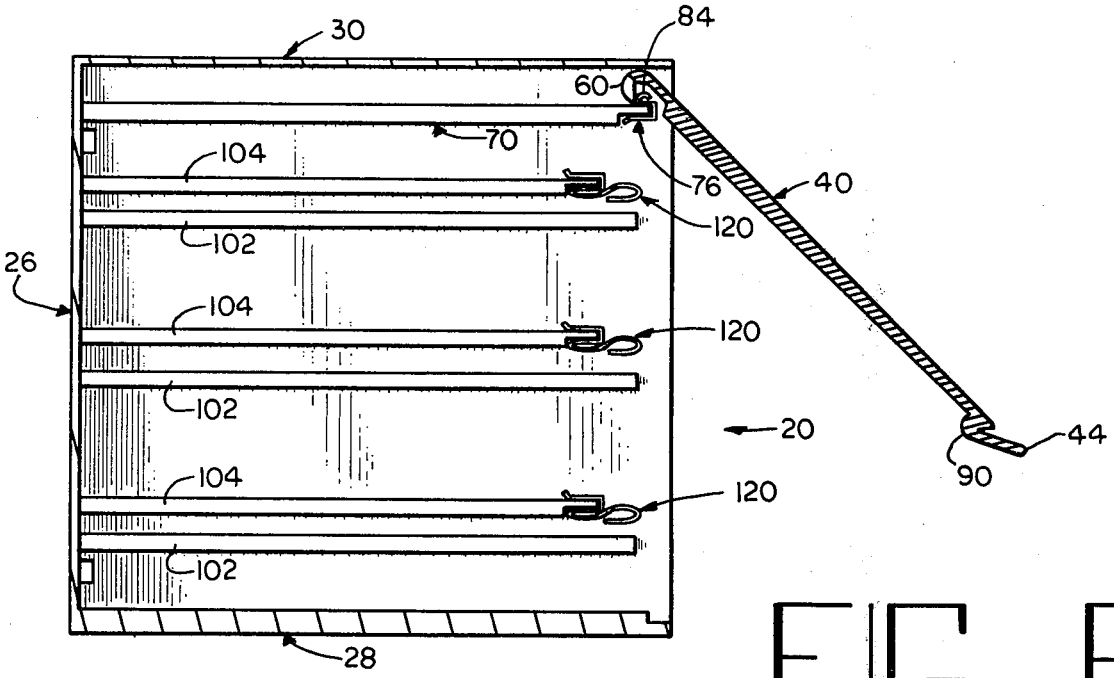
FIG. 6 is a view similar to FIG. 5 but showing the closure panel being pivoted downwardly toward the open front of the unit.
Figure 7:
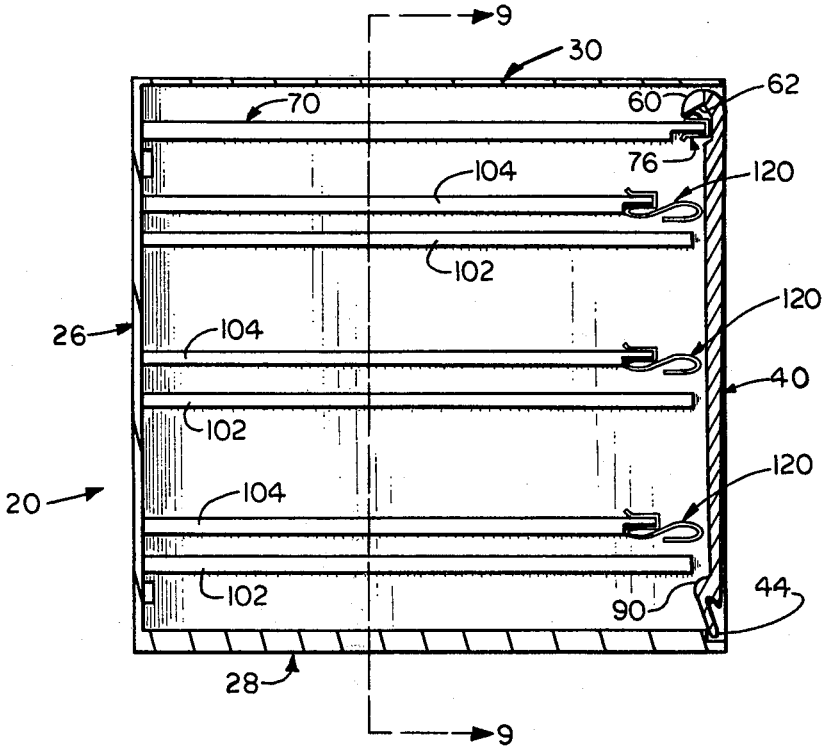
FIG. 7 is a view similar to FIG. 6 but showing the closure panel in place at the front of the unit to close the opening thereto.

Each panel pivot clip 76 further has an end portion 84 on the second leg 80 that is reversely bent and formed to define an arcuate protuberance above the closure panel support flange 70. The closure panel 40 may be slid along the flanges 70 of the unit 20 from a substantially horizontal position within the unit so that each receiving notch 62 in the panel 40 is engaged by the protuberance end portion 84 on one of the panel pivot clips 76. This is illustrated in FIGS. 5, 6, and 7.

Figure 5:
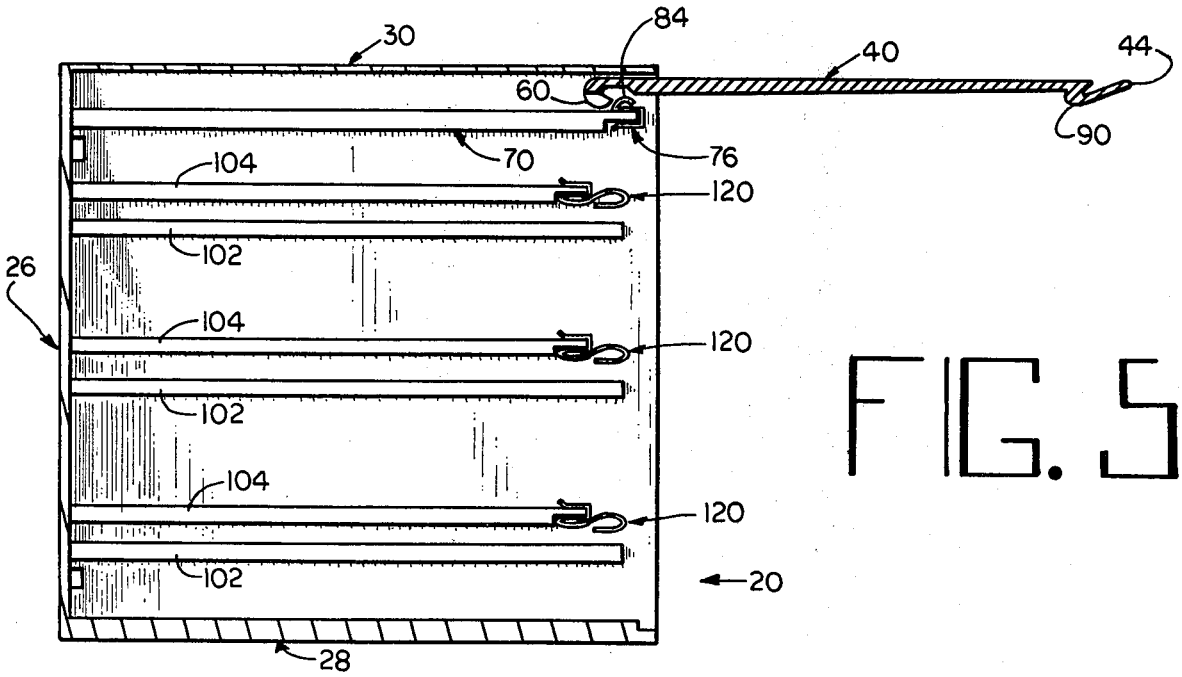
FIG. 5 is a view similar to FIG. 4 but showing the closure panel pulled horizontally outwardly from the retracted horizontal storage position.

In FIG. 5, the panel 40 has been drawn outwardly from the horizontal storage position so that the protuberance 60 on the panel begins to engage the end portion 84 of the clip 76. In FIG. 6, the panel 40 is shown being pivoted downwardly about clip 76 and in FIG. 7 the panel is shown fully pivoted to the vertical position closing the opening at the front of the unit. In the closed position, the panel 40 is hanging from protuberances 60 on each side of the panel. The panel protuberances 60 are engaged with the clip protuberances 84 which are received within the notches 62 defined between the panel protuberances 60 and the panel channels 56.

As best illustrated in FIGS. 1 and 5, the closure panel 40 includes an inwardly projecting arcuate portion 90 adjacent the bottom margin 44 of the panel to provide a surface that may be grasped for pulling the panel 40 from the horizontal storage position adjacent the top wall 30 to the vertical position closing the opening at the front of the storage unit.

As best illustrated in FIGS. 4 and 9, each sidewall 22 and 24 has a plurality of pairs of guide rails, comprising an integrally molded lower guide rail 102 and an integrally molded upper guide rail 104. The upper guide rail 104 is disposed above the lower guide rail 102 to define a guideway therebetween. The guideway is adapted to receive an extending portion of a receptacle, such as of a drawer 110. As best illustrated in FIGS. 8, 9 and 10, each drawer 110 has a laterally extending portion or bearing member 112 which is slidably carried in the guideway defined between lower guide rail 102 and upper guide rail 104.

Figure 8:
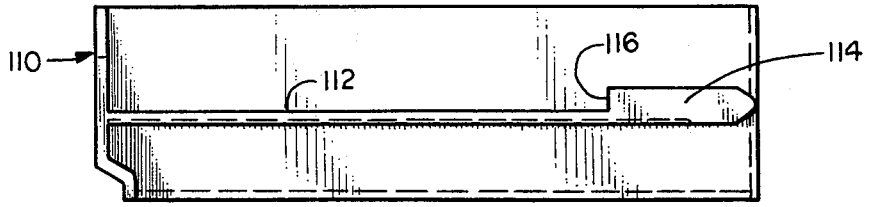
FIG. 8 is a side elevational view of one of the drawers for the storage unit constructed in accordance with the principles of the present invention.

The laterally extending portion of the receptacle, such as bearing member 112 of receptacle 110 in FIG. 8, includes an enlarged region 114 at the rear of the receptacle which is sized to fit within the guideway defined between the lower guide rail 102 and upper guide rail 104 of the storage unit. The enlarged portion 114 defines an abutment surface 116 at its front face.

Figure 10:
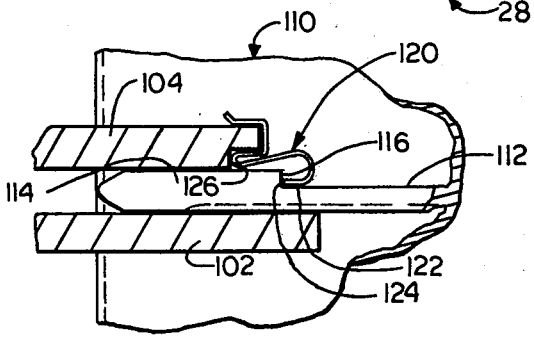
FIG. 10 is a greatly enlarged, fragmentary, cross-sectional view taken generally along the plane 10—10 in FIG. 9.

As best illustrated in FIG. 10, a stop clip 120 is mounted to the front end of each upper guide rail 104. Each clip 120 has a downwardly projecting leg 122 with a rearwardly facing engaging surface 124 for engaging the bearing member abutment surface 116 when the receptacle 110 is withdrawn forwardly out of the storage unit a predetermined amount. This prevents complete withdrawal of the receptacle from the unit.

Preferably, the clip 120 is made from a metallic material, such as spring steel, and is formed into a configuration whereby the clip 120 will engage the forward end of the upper guide rail 104 and be biased downwardly against the bearing member 112 of the receptacle 110.

Preferably, the clip 120 is of conventional design and the forward end of the upper guide rail 104 is notched, as at 126 to facilitate the placement of clip 120 thereon.

If it is desired to remove the receptacle 110 completely from the storage unit, the stop clip 120 may be deflected upwardly by the application of an external force, as by pushing upwardly with one's finger, so as to raise the rearwardly facing engaging surface 124 above the bearing member abutment surface 116.

As best illustrated in FIGS. 7 and 10, the front distal end of the lower guide rail 102 is spaced inwardly of the opening at the front of the storage unit and the front or distal end of the upper guide rail 104 is spaced inwardly of the end of the lower guide rail 102. Preferably, as illustrated in FIG. 10, the front distal end of the lower guide rail 102 extends just beyond the downwardly biased stop clip 120 mounted to the upper guide rail 104.

Figure 11:
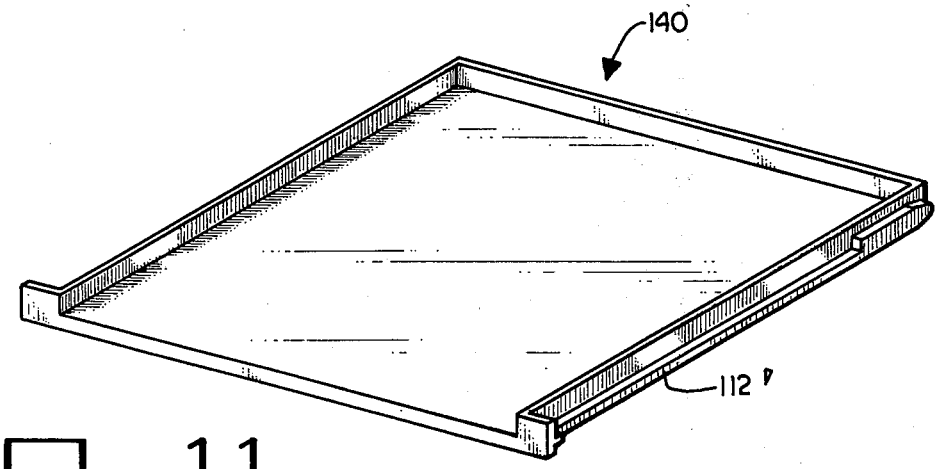
FIG. 11 is a perspective view of a tray for use in the storage unit constructed in accordance with the principles of the present invention.

FIG. 11 illustrates another type of receptacle that may be disposed within the storage unit 20. The receptacle in FIG. 11 is designated generally by the reference numeral 140 and functions as a tray. The tray 140 is similar to the drawer 110 described above with reference to FIGS. 2–10 in that the tray 140 has laterally extending portions or bearing members 112 for being received in the guideways formed between the lower and upper guide rails in the same manner as for the bearing member 112 of the drawer 110.

Figure 12:
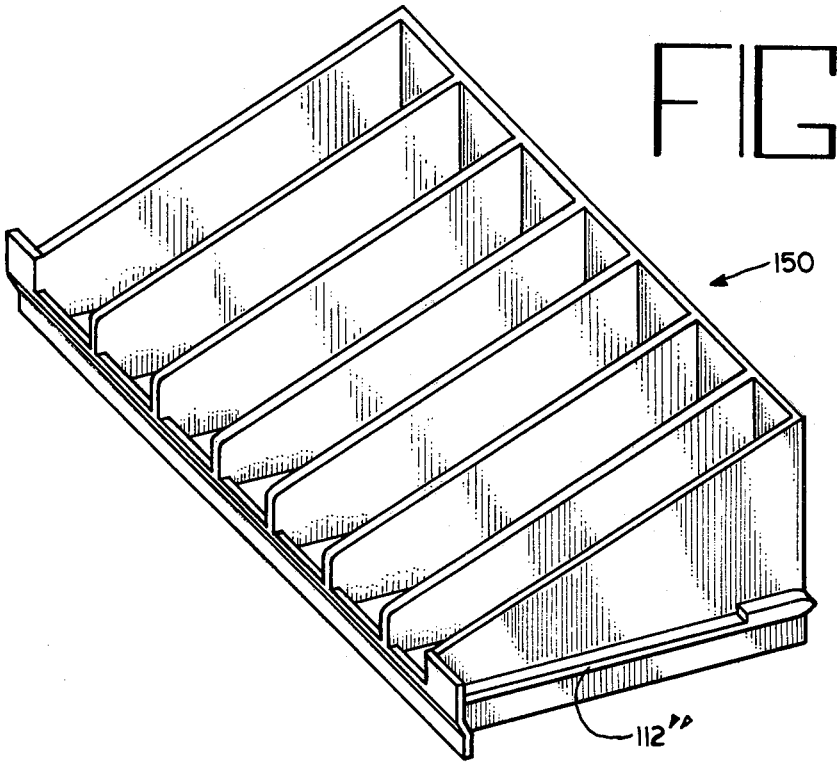
FIG. 12 is a perspective view of a record album storage tray for use with the storage unit constructed in accordance with the principles of the present invention.

FIG. 12 illustrates another type of receptacle for use in the storage unit 20. The receptacle in FIG. 12 is designated generally by the reference numeral 150 and functions as a device for holding record albums or other similarly shaped materials. The record album holder 150 has laterally extending portions or bearing members 112" which function in a manner identical to the bearing members 112 of the drawer receptacle 110 described above with reference to FIGS. 2–10.

Other receptacles, such as book holding trays, bar assembly trays, audio component holding drawers, and the like, though not illustrated, may be provided for mounting within the storage unit 20. Depending upon the size the receptacle, only one such receptacle may fit in the storage unit 20 on opposed pairs of guide rails. In other cases, two or three different types of receptacles may be mounted within the same storage unit.

The preferred embodiment of the storage unit 20 has been illustrated and described above as including pairs of lower and upper guide rails 102 and 104, respectively, for defining a guideway adapted to receive an extending portion 112 of a drawer or other receptacle (FIG. 9). It is to be realized that this drawer support structure may be modified as will next be described.

The upper and lower guide rails may be integrally molded as part of the side of the drawer or receptacle to define a guideway for receiving a single rail member that is integrally molded on the inside wall of the storage unit. A stop clip (functionally equivalent to clip 120 described above) may be mounted in a suitable manner on one of the two guide rails of the drawer and the single rail on the storage unit wall may have a suitably formed abutment surface (functionally similar to abutment surface 116 described above) for being engaged by the stop clip. On the other hand, the stop clip may be mounted in a suitable orientation on the storage unit wall rail while either the upper or lower guide rail on the drawer may have a suitably formed abutment surface for engaging the stop clip.

Figure 13:
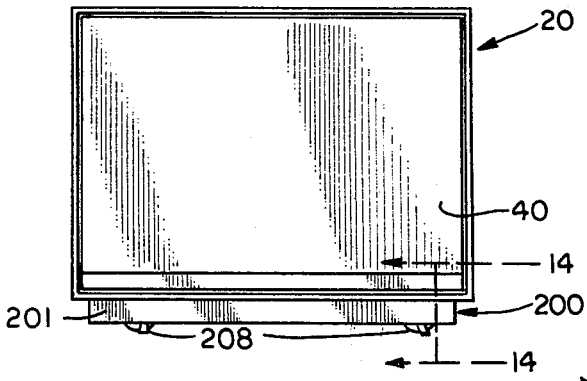
FIG. 13 is a front view of the storage unit of FIG. 1 showing the storage unit mounted on a base member having casters to facilitate moving the storage unit.
Figure 14:
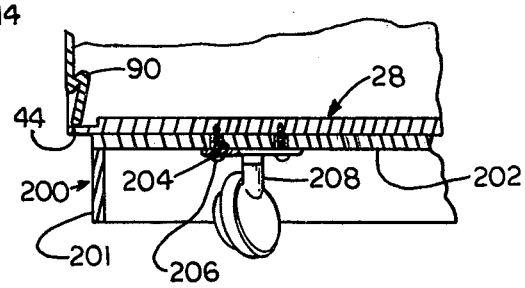
FIG. 14 is a greatly enlarged, fragmentary, cross-sectional view taken generally along the plane 14—14 in FIG. 13.

FIGS. 13 and 14 illustrate the use of the storage unit 20 with a base unit 200 for converting the storage unit 20 into a mobile storage unit which may be easily rolled about the floor. The base unit 200 includes a horizontal member 202 adapted for being secured to the bottom surface of the bottom wall 28 of the unit 20. The base unit 200 also includes downwardly depending skirt walls 201 to provide a pleasing appearance.

The member 202 preferably defines a plurality of bores 204 for receiving screws 206 mounting casters 208 against the underside of the base unit horizontal member 202. Preferably, the bottom wall 28 of the unit 20 has a plurality of threaded bores for receiving the screws 206. The screws 206 may thus function to hold the base unit 200 on the bottom of the unit 20 as well as to hold the casters 208 in place.

As best illustrated in FIG. 15, a plurality of storage units 20 may be stacked vertically and side by side in a variety of desired arrays. To aid in arranging the units 20 in a desired array to form a storage system, a novel connecting mechanism is provided.

Specifically, as best illustrated in FIG. 16, the rear wall 26 of each storage unit 20 defines a plurality of slots 300 communicating with the interior of the unit. The slots 300 have a generally rectangular configuration and are preferably arranged symmetrically with a pair of slots adjacent the top wall, a pair of slots adjacent the bottom wall, and a pair of slots adjacent each opposed wall.

As best illustrated in FIG. 17, a generally U-shaped locking clip 310 may be inserted into the slots 300 so that one leg of the clip 310 is in a slot of one storage unit and so that the other leg of the clip 310 is disposed within a slot of an adjacent storage unit. Preferably, the legs of the U-shaped clip 310 are biased inwardly towards each other to tightly engage the walls of the storage units. The clips 310 hold the adjacent storage units together and prevent them from sliding apart or away from each other.

Additional means may be provided for permitting adjacent units from moving relative to each other. One such means is illustrated in FIG. 18 and comprises a strip 400 of a double-sided polyurethane tape. The tape is placed along the front of the units between the top of a first unit and the bottom of a second unit that is stacked upon the first unit. Similarly, a strip 410 of similar tape may be affixed between the sides of adjacent storage units.

It will be readily observed from the foregoing detailed description of the invention and in the illustrative embodiments thereof that numerous variations and modifications may be effected without departing from the true spirit and scope of the novel concept and principles of this invention.

What is claimed is:

1. A storage unit comprising:

a pair of opposed side walls, a rear wall, a bottom wall, and a top wall together defining a generally box-like structure having an open front;

a movable closure panel adapted to close the front of said unit, said movable closure panel having at least two side margins, a top margin, a bottom margin, and at least an interior surface adapted to face the interior of said unit when said closure panel is positioned to close the open front of said storage unit, said panel further having two protuberances, each said protuberance extending outwardly on said interior surface and downwardly at one of the side margins of the panel to overlie a portion of the panel interior surface and define a receiving notch between the portion of the panel interior surface and a facing portion of the protuberance, said notch being closed at said panel top margin and open towards said panel bottom margin;

each of the sidewalls of said unit having a closure panel support flange projecting into the interior of the storage unit, each said flange being spaced below said storage unit top wall to define a space for receiving a side margin of said closure panel whereby said panel may be stored in a horizontal position on said flanges adjacent said top wall; each said flange terminating in a front end adjacent the front of the storage unit; and each said panel support flange having an upwardly projecting portion on the front end whereby said closure panel may be slid along the flanges of said unit from a substantially horizontal position within said unit wherein each said receiving notch is engaged by one of said flange projecting portions to pivot said panel to a substantially vertical position closing the opening at the front of said unit.

2. The unit in accordance with claim 1 in which a panel pivot clip is disposed on said front end portion of each said panel support flange, said panel pivot clip defining said upwardly projecting portion formed therein.

3. The unit in accordance with claim 1 in which said closure panel has a projecting portion on said interior surface that may be grasped to pull said panel from the horizontal stored position adjacent said top wall to the vertical position closing the opening at the front of the storage unit.

4. The unit in accordance with claim 1 in which each said opposed side wall has a pair of guide rails adapted to support a slidably movable receptacle, each said pair of guide rails being molded integrally with a side wall of said unit and comprising a lower guide rail and and upper guide rail spaced above said lower guide rail to define a guide way therebetween, said guide way adapted to receive an extending portion of a receptacle to permit the receptacle to be slidably carried between said upper and second lower guide rails.

5. The unit in accordance with claim 4 further including a receptacle having a length and width of dimensions sufficient to enable the receptacle to be positioned within said unit in a generally horizontal orientation, said support member having a bearing member projecting outwardly on either side and adapted to be received between a pair of said guide rails and be slidably supported on at least said lower guide rail.

6. The unit in accordance with claim 4 in which said lower guide rail has a distal end spaced inwardly of the opening at the front of the unit and in which said upper guide rail has a distal end spaced inwardly of the distal end of said lower guide rail.

7. The unit in accordance claim 1 in which said rear wall defines a plurality of slots, said slots having a generally rectangular configuration whereby said unit may be disposed adjacent a similar unit so that a leg of a U-shaped clip can be inserted into a slot in said unit generally normal to said rear wall and so that the other leg of the U-shaped clip can be inserted into a slot in said adjacent similar unit to hold the two units together.

8. The unit in accordance with claim 7 in which said rear wall has a pair of slots oriented adjacent said top wall, a pair of slots oriented adjacent said bottom wall, and a pair of slots oriented adjacent each opposed side wall.

9. The unit in accordance with claim 1 in which said unit defines a cube.

10. The unit in accordance with claim 1 further including a plurality of threaded apertures in said bottom wall and further including a base unit, said base unit including a horizontal rectangular plate-like member having downwardly depending skirt members; said base unit further including casters disposed on the underside of said horizontal plate-like member, said casters being mounted with screws extending through said horizontal plate-like member and into said apertures whereby said casters facilitate moving said unit.

11. A storage unit comprising:

a pair of opposed side walls, a rear wall, a bottom wall, and a top wall together defining a generally box-like structure having an open front;

a movable closure panel adapted to close the front of said unit, said movable closure panel having at least two side margins and at least an interior surface adapted to face the interior of said unit when said closure panel is positioned to close the open front of said storage unit, said panel further having two protuberances, each said protuberance extending outwardly on said interior surface and downwardly at one of the side margins of the panel to overlie a portion of the panel interior surface and define a receiving notch between the portion of the panel interior surface and a facing portion of the protuberance;

each of the sidewalls of said unit having a closure panel support flange projecting into the interior of the storage unit, each said flange being spaced below said storage unit top wall to define a space for receiving a side margin of said closure panel whereby said panel may be stored in a horizontal position on said flanges adjacent said top wall; each said flange terminating in a front end adjacent the front of the storage unit;

each said panel support flange having an upwardly projecting portion on the front end whereby said closure panel may be slid along the flanges of said unit from a substantially horizontal position within said unit wherein each said receiving notch is engaged by one of said flange projecting portions to pivot said panel to a substantially vertical position closing the opening at the front of said unit;

each said opposed side wall having a pair of guide rails adapted to support a slidably movable receptacle, each said pair of guide rails being molded integrally with a side wall of said unit and comprising a lower guide rail and and upper guide rail spaced above said lower guide rail to define a guide way therebetween, said guide way adapted to receive an extending portion of a receptacle to permit the receptacle to be slidably carried between said upper and second lower guide rails; and a receptacle having a length and width of dimensions sufficient to enable the receptacle to be positioned within said unit in a generally horizontal orientation, said support member having a bearing member projecting outwardly on either side and adapted to be received between a pair of said guide rails and be slidably supported on at least said lower guide rail, each said receptacle bearing member including a substantially vertical abutment surface, each said upper guide rail including a downwardly projecting stop clip, said stop clip being resiliently biased downwardly into engagement with said bearing member and having a rearwardly facing engaging surface for engaging said bearing member abutment surface when the receptacle is withdrawn forward out of said unit a predetermined amount so that the engagement between said stop clip and said bearing member abutment surface prevents complete withdrawal of said receptacle from said unit, said stop clip being deflectable upwardly by application of an external force to permit the receptacle to be withdrawn completely out of the unit.

12. A storage unit comprising:

material molded to form a pair of opposed side walls, a rear wall, a bottom wall, and a top wall together defining a generally box-like structure having an open front;

a movable closure panel adapted to close the front of said unit, said movable closure panel having top and bottom margins, two side margins, and exterior and interior surfaces, said interior surface adapted to face the interior of said unit and said exterior surface adapted to face away from said unit when said closure panel is postioned to close the open front of said storage unit, said interior surface of said panel defining a channel spaced inwardly of said top margin at each side margin, said panel further having two protuberances, each said protuberance extending outwardly on said interior surface and downwardly from said top margin at one of said side margins, said protuberance at each side margin overlying a portion of the channel at that side margin to define a receiving notch between the panel interior surface forming the channel and a facing portion of the protuberance;

each of the sidewalls of said unit having a closure panel support flange integrally molded therewith and projecting into the interior of the storage unit, each said flange being spaced below said top wall to define a space for receiving a side margin of said closure panel whereby said panel may be stored in a horizontal position on said flanges adjacent said top wall; each said flange terminating in a front end that is spaced inwardly of the front of the storage unit; and two panel pivot clips formed from a resilient material and each having a first leg, a second leg, and a middle connecting portion joining said first and second legs in a generally U-shaped configuration, each said clip being positioned on said front end of one of said flanges with the one flange disposed between the resiliently engaged by said first and second legs with the second leg being disposed above the one flange and with the first leg being disposed below the one flange, each said panel clip further having an end portion of said second leg reversely bent and formed to define an arcuate protuberance above the support flange on which said clip is mounted, whereby said closure panel may be slid along the flanges of said unit from a substantially horizontal position within said unit wherein each said receiving notch is engaged by a protuberance on one of said panel pivot clips to pivot said panel to a substantially vertical position closing the opening at the front of said unit.

13. The unit in accordance with claim 12 in which each said flange is notched adjacent said front end to define an end portion having a reduced height and in which said panel pivot clip is disposed on said reduced end portion.

14. The unit in accordance with claim 12 in which said closure panel includes a projecting arcuate portion adjacent the bottom margin of said panel to provide a surface that may be grasped to pull said panel from the horizontal stored position adjacent said top wall to the vertical position closing the opening at the front of the storage unit.

15. The unit in accordance with claim 12 in which the channel along one side margin of the closure panel extends inwardly to join the other channel extending inwardly from said other side margin of the panel to thereby form a single, continuous channel across said panel.

* * * * *